US006589720B2

(12) United States Patent
Bourdelais et al.

(10) Patent No.: US 6,589,720 B2
(45) Date of Patent: Jul. 8, 2003

(54) CREASE RESISTANT IMAGING ELEMENT WITH COATED PAPER BASE

(75) Inventors: Robert P. Bourdelais, Pittsford, NY (US); Peter T. Aylward, Hilton, NY (US); Geoffrey Mruk, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/045,712

(22) Filed: Oct. 29, 2001

(65) Prior Publication Data

US 2003/0087208 A1 May 8, 2003

(51) Int. Cl.[7] ..... G03C 1/79; G03C 1/795; G03C 1/93; G03C 11/22; B41J 2/01

(52) U.S. Cl. ..... 430/432; 430/104; 430/201; 430/496; 430/527; 430/533; 430/536; 430/538; 347/105; 428/481; 428/511; 428/512; 428/537.5

(58) Field of Search ..... 430/536, 538, 430/164, 201, 533, 496, 432, 527; 347/105; 428/481, 511, 512, 537.5

(56) References Cited

U.S. PATENT DOCUMENTS

| | | | | | |
|---|---|---|---|---|---|
| 5,866,282 | A | | 2/1999 | Bourdelais et al. | 430/536 |
| 6,022,677 | A | * | 2/2000 | Bourdelais et al. | 430/536 |
| 6,030,742 | A | | 2/2000 | Bourdelais et al. | 430/536 |
| 6,040,036 | A | | 3/2000 | Aylward et al. | 430/536 |
| 6,087,079 | A | | 7/2000 | Newberry et al. | 430/536 |
| 6,107,014 | A | | 8/2000 | Dagan et al. | 430/536 |
| 6,132,942 | A | * | 10/2000 | Woodworth et al. | 430/536 |
| 6,207,362 | B1 | | 3/2001 | Dagan et al. | 430/536 |
| 6,277,547 | B1 | | 8/2001 | Bourdelais et al. | 430/536 |
| 6,287,743 | B1 | | 9/2001 | Oakland et al. | 430/536 |
| 6,391,532 | B1 | * | 5/2002 | Sunderrajan et al. | 430/536 |

FOREIGN PATENT DOCUMENTS

| | | |
|---|---|---|
| EP | 0 952 483 | 9/2001 |

* cited by examiner

*Primary Examiner*—Richard L. Schilling
(74) *Attorney, Agent, or Firm*—Paul A. Leipold

(57) ABSTRACT

The invention relates to an imaging element comprising a coated coated paper base, a lower biaxially oriented sheet, and an upper biaxially oriented sheet.

37 Claims, No Drawings

CREASE RESISTANT IMAGING ELEMENT WITH COATED PAPER BASE

FIELD OF THE INVENTION

This invention relates to reflective imaging materials. In a preferred form it relates to laminated base materials for imaging elements.

BACKGROUND OF THE INVENTION

In the formation of imaging paper it is known that the base paper has applied thereto a layer of polyolefin resin, typically polyethylene. This layer serves to provide waterproofing to the paper and provides a smooth surface on which the photosensitive layers are formed. The formation of the smooth surface is controlled by both the roughness of the chill roll where the polyolefin resin is cast, the amount of resin applied to the base paper surface, and the roughness of the base paper. Since the addition of polyolefin resin to improve the surface adds significant cost to the product it would be desirable if a smoother base paper could be made to improve the gloss of imaging paper. Sheet properties such as smoothness may be improved through the addition of inorganic particulate filler materials to paper making furnishes.

It has been proposed in U.S. Pat. No. 5,866,282 (Bourdelais et al.), to utilize a composite support material with laminated biaxially oriented polyolefin sheets as a imaging imaging material. In U.S. Pat. No. 5,866,282 , biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. The composite imaging support structure described in U.S. Pat. No. 5,866,282 has been found to be more durable, sharper and brighter than prior art imaging paper imaging supports that use cast melt extruded polyethylene layers coated on cellulose paper. While the voided polymer layer does provide a significant improvement to image sharpness and brightness, the voided polymer is susceptible to cracking during bending of the imaging element.

It has been proposed in U.S. Pat. No. 6,040,036 to utilize a microvoided layer of sufficient strength to reduce cracking during bending of the imaging element. While the imaging element disclosed in U.S. Pat. No. 6,040,036 does reduce cracking and retains the beneficial properties of a voided layer, the imaging element is still susceptible to cracking. Cracking of the image layer reduces the commercial value of the image and particularly for labels that are wrapped around packages, reduces the perceived quality of the package contents.

The addition of inorganic particulate fillers such as clay, $TiO_2$, calcium carbonate and talc, improves sheet properties because the particles fill in the void spaces within the fiber mat resulting in a denser, brighter, smoother, and more opaque sheet. In some instances, paper can also be made cheaper because the filler used is less expensive than cellulose fiber.

The substitution of fiber with filler in the sheet is, however, limited by the resultant reduction in strength, density, and sizing properties. As the proportion of filler is increased, fiber-to-fiber bonding is disrupted resulting in a reduction in sheet strength and stiffness properties. Due to the filling of sheet voids with increasing filler addition, sheet density is increased. The increased hydrophilicity of inorganic fillers over chemically-treated (sized) paper-making fibers also results in a reduction in sizing properties of the coated paper. All of the above undesirable changes limit the use of filler materials in various applications, particularly in imaging coated paper, where even a small change in any of the above properties can seriously affect efficacy of the resulting image as a photograph. In addition to the above, the choice of filler is also limited because of it's impact on sheet properties or because of it's undesired presence in processing steps. For example, the filler material should not have photographic activity or degrade the performance of the imaging element in which it is utilized.

In EP 952483, coated paper in combination with an extruded polyethylene layer is disclosed as a method for reducing coating craters at lamination speeds greater than 300 meters/min. as air is trapped between the paper and the polyethylene coating. Coated paper with a roughness average of less than 1.0 micrometers is disclosed and is shown to reduce coating craters. While a coated paper does reduce coating craters caused by trapped air during the extrusion coating of the paper, coated paper is not required for lamination of high modulus polymer sheets as lamination does not suffer from trapped air at high speeds. Further, it has been shown that coated paper with a surface roughness greater than 1.0 micrometers provides a high quality, glossy image. Finally, the paper coating formulations in EP 952483 have been shown to provide an unacceptable bond between the coated paper and high modulus polymer sheets during extrusion lamination.

Roll feed, glue applied labels are typically utilized to wrap packages and the label is adhered to the package using glue applied to the label or the package. Prior art roll feed, glue applied label comprise ink printed oriented polymer sheets that are over laminated with a polymer sheet after printing. The base materials typically utilized for the roll feed glue applied labels are not stiff enough for efficient transport through photographic printers and processors. Further, there is a continuing need to improve the quality of the images on roll feed, glue applied labels.

PROBLEM TO BE SOLVED BY THE INVENTION

There remains a need for an improved imaging paper to provide improved image gloss, a stronger imaging element, less image curl over a wide range of relative humidity, higher image sharpness, and improved image whiteness while providing resistance to image creasing.

SUMMARY OF THE INVENTION

It is an object of the invention to provide improved imaging papers.

It is another object to provide photosensitive images having improved surface smoothness.

It is a further object to provide a imaging paper with improved curl properties.

It is another object to provide tear resistant imaging paper.

It is a further object to provide a imaging paper with resistance to creasing caused by consumer handling.

It is another object to provide an integral imaging emulsion adhesion layer.

It is further object to provide a lamination bonding layer that resists delamination of the support.

These and other objects of the invention are accomplished by an imaging element comprising a coated paper base, a lower biaxially oriented sheet, and an upper biaxially oriented sheet.

ADVANTAGEOUS EFFECT OF THE INVENTION

The invention provides an improved base for casting of photosensitive layers. It particularly provides improved base for color imaging materials that have greater resistance to curl, an improved image, tear resistance, and resistance to image creasing.

DETAILED DESCRIPTION OF THE INVENTION

The invention has numerous advantages over prior practices in the art. The invention provides a imaging element that has much less tendency to curl when exposed to extremes of humidity. Further, the invention provides a imaging paper that is much lower in cost as the criticalities of the formation of the polyethylene are removed. There is no need for the difficult and expensive casting and cooling in forming a surface on the polyethylene layer, as the biaxially oriented polymer sheet of the invention provides a high quality surface for casting of photosensitive layers. The optical properties of the imaging elements in accordance with the invention are improved, as the color materials may be concentrated at the surface of the biaxially oriented sheet for most effective use with little waste of the colorant materials. Imaging materials utilizing oriented polymer sheets of the invention have improved resistance to tearing and creasing compared to prior art microvoided polymer sheets. The imaging materials of the invention are lower in cost to produce, as the polymer sheet may be scanned for quality prior to assembly into the imaging member. With present polyethylene layers the quality of the layer cannot be assessed until after complete formation of the base paper with the polyethylene waterproofing layer attached. Therefore, any defects result in expensive discard of expensive product. The invention allows faster hardening of imaging paper emulsion, as water vapor is not transmitted from the emulsion through the biaxially oriented sheets.

The imaging elements of this invention are more scratch resistant as the oriented polymer sheet on the back of the imaging element resists scratching and other damage more readily than prior art extruded polyethylene layers. The imaging elements of this invention are balanced for stiffness in the machine and cross directions. A balanced stiffness of the imaging element is perceptually preferred over a imaging element that is predominantly stiff in one direction. The imaging elements of this invention utilize a low cost method for printing multiple color branding information of the backside of the image, increasing the content of the information on the backside of the image. The paper base used in the invention is smoother and substantially free of undesirable orange peel which interferes with the viewing of the image.

The imaging elements of this invention utilize an integral emulsion bonding layer that allows the emulsion to adhere to the support materials during manufacturing and wet processing of images. The polymer sheets of the invention are laminated to the base paper utilizing a bonding layer that prevents delamination of the biaxially oriented sheets from the base paper.

Because the image element of the invention is stiff, thin and crease resistant, the image element of the invention can be utilized for roll feed, glue applied packaging labels. Also, because the invention material is thick, the label tends to hide the surface of the package being labeled. Examples include ribs on a coffee can and seam lines on an aerosol can. This novel imaging base allows silver halide, Ink Jet and Thermal Dye Transfer images to be used for high quality labels that are applied to a package utilizing an adhesive. The novel base provides the tear resistance for high speed labeling, smooth surface for high quality images and a stiff base for efficient transport in printers and processors. These and other advantages will be apparent from the detailed description below.

The terms as used herein, "top", "upper", "emulsion side", and "face" mean the side or toward the side of an imaging member bearing the imaging layers. The terms "bottom", "lower side", and "back" mean the side or toward the side of the imaging member opposite from the side bearing the photosensitive imaging layers or developed image.

The invention utilizes biaxially oriented polymer sheet that are free of microvoids. Microvoided polymer sheet do provide excellent opacity, lightness and image sharpness. However, the voided layer tends to be somewhat delicate and can permanently deform under the high stress of bending that can be applied to an image when the image is subjected to handling by consumers. Because the oriented polymer sheets of the invention, which are adhesively adhered to the coated paper base, replicate the surface of the coated paper, the invention also utilizes a coated cellulose coated paper base. A coated coated paper base has been shown to provide a smooth surface required to produce a high quality, glossy image. Without a coated coated paper base, the laminated polymer sheet would replicate the surface of the coated paper, resulting in an image that contained unacceptable "orange peel" roughness.

Because the image element of the invention is tough, thin and crease resistant, the image element allows high quality images that are created utilizing silver halide imaging layers, ink jet imaging layers or thermal dye transfer imaging layers to be used as roll feed, glue applied labels. The image base of the invention allows for efficient transport and image creation in existing imaging, ink jet and thermal dye transfer equipment and allows for efficient labeling of packages utilizing existing glue applied labeling equipment. In order for the image of the invention to be utilized for a roll feed label, the image preferably has an environmental protection layer applied to improve the durability of the image for use in labeling of packages. Examples of high quality roll feed, glue applied labels include labeling of polyester water bottles, coffee cans, aerosol cans and beer bottles.

The layers of the biaxially oriented polymer sheet of this invention have levels of white pigment, optical brightener, and colorants adjusted to provide optimum optical properties for image sharpness, lightness, and opacity. The biaxially oriented polyolefin sheet is laminated to a coated cellulose coated paper base for stiffness for efficient image processing, as well as consumer product handling. Lamination of high strength biaxially oriented polyolefin sheets to the coated coated paper significantly increases the tear resistance of the imaging element compared to present imaging coated paper. The biaxially oriented sheets are laminated with an ethylene metallocene plastomer that allows for lamination speeds exceeding 500 meters/min and optimizes the bond between the coated paper base and the biaxially oriented polymer sheets.

The cellulose coated paper base of the invention has a surface that is substantially free of undesirable orange peel surface roughness which interferes with the viewing of images by the consumer. During lamination it has been found that the biaxially oriented polyolefin sheet replicates the surface of the coated paper base very well compared to the prior art practice of melt extrusion coating of polyethylene onto the coated paper base. The orange peel in the coated paper base is significantly reduced compared to prior art imaging coated paper bases by rewetting the surface of the coated paper prior to final calendering, increasing fiber refining, and decreasing the fiber length. The cellulose coated paper base also has a machine direction to cross direction stiffness ratio of 1.7. This may be compared to prior art imaging coated paper bases which have a typical ratio of 2.2. The reduction in the machine direction to cross direction ratio, combined with the strength properties of the biaxially oriented sheets, allows for a stiffness balanced imaging element where the stiffness in the machine direction is roughly the same as the stiffness in the cross direction. Present imaging coated paper machine direction stiffness is typically 200% of the cross direction stiffness. An imaging element with a balanced stiffness is perceptually preferred over present imaging coated papers.

The biaxially oriented sheets used in the invention contain an integral emulsion bonding layer which avoids the need for expensive priming coatings or energy treatments. The bonding layer used in the invention is a low density polyethylene skin on the biaxially oriented sheet. Gelatin based silver halide emulsion layers and inkjet receiving of the invention have been shown to adhere well to low density polyethylene. The integral bonding skin layer also serves as a carrier for the blue tints that correct for the native yellowness of the gelatin based silver halide image element. Concentrating the blue tints in the thin, skin layer reduces the amount of expensive blue tint materials when compared to prior art imaging papers that contain blue tint materials dispersed in a single thick layer of polyethylene.

The backside of the imaging element is laminated with a biaxially oriented sheet to reduce humidity image curl. There are particular problems with prior art color coated papers when they are subjected to extended high humidity storage such as at greater than 50% relative humidity. The high strength biaxially oriented sheet on the backside resists the curling forces, producing a much flatter image. The biaxially oriented sheet on the back has roughness at two frequencies to allow for efficient conveyance through imaging processing equipment and improved consumer writability as consumers add personal information to the backside of imaging coated paper with pens and pencils. The biaxially oriented sheet also has an energy to break of less than $4.0\times10^7$joules per cubic meter to allow for efficient chopping and punching of the imaging element during imaging processing of images.

Because the support materials of the invention are superior to prior art imaging base materials, the support materials of the invention also are superior base materials for digital imaging technology. By coating digital printing ink or dye receiver layers on the top of the support materials of the invention, image quality and image durability can be improved over prior art materials. Examples of suitable digital imaging ink or dye receiver layer technology include ink jet printing receiver layers, thermal dye transfer receiving layers, and electro-imaging receiving layers.

Biaxially oriented polymer sheets are preferred for the upper and lower biaxially oriented sheet. Biaxially oriented polymers have been shown to improve tear resistance, reduce image creasing compared to microvoided polymer sheet and reduce image curl caused by contacting gelatin typically utilized in photographic and ink jet imaging layers. Such oriented sheets are disclosed in U.S. Pat. Nos. 4,377,616; 4,758,462; 4,632,869; 5,968,722 and 6,030,742.

The total thickness of the composite oriented polymer sheet can range from 12 to 100 $\mu$m, preferably from 20 to 70 $\mu$m. Below 20 $\mu$m, the sheets may not be thick enough to minimize any inherent non-planarity in the support and would be more difficult to manufacture. At thickness higher than 70 $\mu$m, little improvement in either surface smoothness or mechanical properties is seen, and so there is little justification for the further increase in cost for extra materials.

A preferred material is a biaxially oriented polyolefin sheet that is coated with high barrier polyvinylidene chloride in a range of coverage 1.5 to 6.2 g/m$^2$. Polyvinyl alcohol can also be used but is less effective under high relative humidity conditions. Through the use of at least one of these materials in combination with a biaxially oriented sheet and a polymer tie layer, it has been shown that improved rates of emulsion hardening can be achieved. In said imaging or imaging element, the water vapor barrier can be achieved by integrally forming said vapor barrier by coextrusion of the polymer(s) into at least one or more layers and then orienting the sheet by stretching it in the machine direction and then the cross direction. The process of stretching creates a sheet that is more crystalline and has better packing or alignment of the crystalline areas. Higher levels of crystallinity results in lower water vapor transmissions rates which, in turn, results in faster emulsion hardening. The oriented sheet is then laminated to a coated paper base.

The control of water vapor transmission can be provided by any layer independently such as the tie layer or the biaxially oriented polyolefin sheet or in combination with each other. With the incorporation of other layer(s) that are integrally formed with, applied to, or bonded with the polyolefin sheet, the water vapor transmission rate can be adjusted to achieve the desired imaging or imaging results. One or more of the layers comprising the polyolefin sheet tie layer combinations may contain $TiO_2$ or other inorganic pigment. In addition, one or more of the layers comprising the polyolefin sheet may be voided. Other materials that can be used to enhance the water vapor transmission characteristics comprise at least one material from the group consisting of polyethylene terephthalate, polybutylterephthalate, acetates, cellophane polycarbonates, polyethylene vinyl acetate, ethylene vinyl acetate, methacylate, polyethylene methylacrylate, acrylates, acrylonitrile, polyester ketone, polyethylene acrylic acid, polychlorotrifluoroethylene, polychlorotrifluoroethylene, polytetrafluoroethylene, amorphous nylon, polyhydroxyamide ether, and metal salt of ethylene methacrylic acid copolymers.

An imaging element comprising a coated paper base, at least one photosensitive silver halide layer, a layer of biaxially oriented polymer sheet between said coated paper base and said silver halide layer, and at least one polymer layer between said biaxially oriented polymer sheet and said coated paper base which binds the two together, wherein between the coated paper and the opaque layers of said biaxially oriented sheet, there is located at least one oxygen barrier layer having less than 2.0 cc/m$^2$ hr atm (20° C., dry state) oxygen transmission rate is preferred. The terms used herein, "bonding layer", "adhesive layer", and "adhesive" mean the melt extruded resin layer between the biaxially oriented polyolefin sheets and the base coated paper, "oxygen impermeable layer" and "oxygen barrier layer" refer to the layer having oxygen permeability of not more than 2.0 cc/m$^2$ hr atm according to the method defined in ASTM D-1434-63 when the layer is measured on its own as a discrete sample.

In one embodiment of this invention it has been shown that when an oxygen barrier of at least 2.0 cc/m$^2$ hr. atm. is provided as an integral part of the biaxially oriented sheet, improved fade performance is achieved after exposure to light fade conditions. In the preferred embodiment of this invention, said barrier layer is ethylene vinyl alcohol and in the most preferred embodiment is polyvinyl alcohol. Additionally it has been shown that the application of an aliphatic polyketone polymer between the emulsion and the imaging coated paper base forms an oxygen barrier of about 2.0 $cc/m^2$. It is further demonstrated that an imaging element with an integral layer comprising one member selected from the group consisting of homo- and co-polymers of acrylonitrile, alkyl acrylates such as methyl acrylate, ethyl acrylate, and butyl acrylate, alkyl methacrylates such as methyl methacrylate and ethyl methacrylate, methacrilonitrile, alkyl vinyl esters such as vinyl acetate, vinyl proprionate, vinyl ethyl butyrate and vinyl phenyl acetate, alkyl vinyl ethers such as methyl vinyl ether, butyl vinyl ether and chloroethyl vinyl ether, vinyl alcohol, vinyl chloride, vinylidene chloride, vinyl floride, styrene and vinyl acetate (in the case of copolymers, ethylene and/or propylene can be used as comonomers), cellulose acetates such as diacetyl cellulose and triacetyl cellulose, polyesters such as polyethylene terephthalate, a fluorine resin, polyamide (nylon), polycarbonate, polysaccharide, aliphatic polyketone, blue dextran, and cellophane with an oxygen transmission at equal to or less than 2.0 $cc/m^2$ hr. atm. provides improved performance for dye fade.

For the biaxially oriented sheet on the top side toward the imaging layers, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

The total thickness of the top most skin layer should be between 0.20 $\mu$m and 1.5 $\mu$m, preferably between 0.5 and 1.0 $\mu$m. Below 0.5 $\mu$m any inherent nonplanarity in the coextruded skin layer may result in unacceptable color variation. At skin thickness greater than 1.0 $\mu$m, there is a reduction in the imaging optical properties such as image resolution. At thickness greater than 1.0 $\mu$m, there is also a greater material volume to filter for contamination such as clumps or poor color pigment dispersion.

Addenda may be added to the topmost skin layer to change the color of the imaging element. For imaging use, a white base with a slight bluish tinge is preferred. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, and Irgalite organic blue pigments. Optical brightener may also be added to the skin layer to absorb UV energy and emit light largely in the blue region. $TiO_2$ may also be added to the skin layer. While the addition of $TiO_2$ in the thin skin layer of this invention does not significantly contribute to the optical performance of the sheet, it can cause numerous manufacturing problems such as extrusion die lines and spots. The skin layer substantially free of $TiO_2$ is preferred. $TiO_2$ added to a layer between 0.20 and 1.5 $\mu$m does not substantially improve the optical properties of the support, will add cost to the design, and will cause objectionable pigments lines in the extrusion process.

Addenda may be added to the core matrix and/or to one or more skin layers to improve the optical properties of the imaging support. Titanium dioxide is preferred and is used in this invention to improve image sharpness or MTF, opacity, and whiteness. The $TiO_2$ used may be either anatase or rutile type. Further, both anatase and rutile $TiO_2$ may be blended to improve both whiteness and sharpness. Examples of $TiO_2$ that are acceptable for a imaging system are DuPont Chemical Co. R101 rutile $TiO_2$ and DuPont Chemical Co. R104 rutile $TiO_2$. Other pigments known in the art to improve imaging optical responses may also be used in this invention. Examples of other pigments known in the art to improve whiteness are talc, kaolin, $CaCO_3$, $BaSO_4$, ZnO, $TiO_2$, ZnS, and $MgCO_3$. The preferred $TiO_2$ type is anatase, as anatase $TiO_2$ has been found to optimize image whiteness and sharpness with a voided layer.

The preferred weight percent of white pigment to be added to the biaxially oriented layers can range from 2% to 24%. Below 6% the optical properties of the voided biaxially oriented sheet do not show a significant improvement over prior art imaging coated paper. Above 32%, manufacturing problems such as unwanted voiding and a loss of coating speed are encountered. The voided layer may also contain white pigments.

Addenda may be added to the biaxially oriented polymer sheet of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside as sunlight contains ultraviolet energy and may be used to optimize image quality for consumer and commercial applications.

Addenda known in the art to emit visible light in the blue spectrum are preferred. Consumers generally prefer a slight blue tint to the density minimum areas of a developed image defined as a negative b* compared to a neutral density minimum defined as a b* within one b* unit of zero. b* is the measure of yellow/blue in CIE (Commission Internationale de L'Eclairage) space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated with a ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore, is it not cost effective to add optical brightener to the biaxially oriented sheet when the b* is changed by less than 1 b* unit. An emission greater that 5 b* units would interfere with the color balance of the images making the whites appear too blue for most consumers.

The preferred addenda of this invention is an optical brightener. An optical brightener is a colorless, fluorescent, organic compound that absorbs ultraviolet light and emits it as visible blue light. Examples include, but are not limited to, derivatives of 4,4'-diaminostilbene-2,2'-disulfonic acid, coumarin derivatives such as 4-methyl-7-diethylaminocoumarin, 1-4-Bis(O-Cyanostyryl) Benzol and 2-Amino-4-Methyl Phenol.

The present invention in a preferred embodiment consists of a multilayer film of biaxially oriented polyolefin which is attached to both the top and bottom of a imaging quality coated paper support by melt extrusion of a polymer tie layer. The biaxially oriented films that have been used in this invention contain a plurality of layers.

The coextrusion, quenching, orienting, and heat setting of these oriented polymer composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature and below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers, while restraining to some degree the sheet against retraction in both directions of stretching.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

The structure of a preferred upper biaxially oriented sheet of the invention where the exposed surface layer is adjacent to the imaging layer is as follows:

Polyethylene exposed surface layer with blue tint
Polypropylene layer containing 6% anatase $TiO_2$
Polypropylene The sheet on the side of the base coated paper opposite to the imaging layers or bottom sheet preferably is a oriented polymer sheet free of voids. Oriented polymer sheet adhered to the bottom of the coated paper provide tear resistance and resistance to image curl, particularly in combination with gelatin based imaging layers. Such biaxially oriented sheets are disclosed in, for example, U.S. Pat. No. 4,764,425.

The preferred backside biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent nonplanarity in the support and would be more difficult to manufacture. At thickness higher than 70 $\mu$m, little improvement in either surface smoothness or mechanical properties is seen, and so there is little justification for the further increase in cost for extra materials.

Suitable classes of thermoplastic polymers for the backside biaxially oriented sheet core and skin layers include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins for the core and skin layers of the backside sheet include polypropylene, polyethylene, polymethylpentene, and mixtures thereof. Polyolefin copolymers, including copolymers of propylene and ethylene such as hexene, butene, and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclobexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with one or more layers of the same polymeric material, or it can be made with layers of different polymeric composition. For compatibility, an auxiliary coextruded layer can be used to promote adhesion of multiple layers.

The coextrusion, quenching, orienting, and heat setting of the bottom biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The quenched bottom sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers, while restraining to some degree the sheet against retraction in both directions of stretching. A typical biaxial orientation ratio for the machine direction to cross direction is 5:8. A 5:8 orientation ratio develops the mechanical properties of the biaxially oriented sheet in both the machine and cross directions. By altering the orientation ratio, the mechanical properties of the biaxially oriented sheet can be developed in just one direction or both directions. An orientation ratio that yields the desired mechanical properties of this invention is 2:8.

In the photofinishing process it is necessary that the photofinishing equipment chops rolls of imaging coated paper into the final image format. Generally, the photofinishing equipment is only required to make chops in the cross machine direction, as the manufacturer of the imaging element has previously cut to a width that is suitable for the photofinishing machine being utilized. It is necessary that these chops in the cross direction be accurate and cleanly made. Inaccurate cuts lead to fiber projections hanging from the prints which is undesirable. The undesirable fiber projections are primarily torn backside polymer sheet and not cellulose coated paper fiber. Further, poor cross machine direction cutting can lead to edge damage on the final image. With imaging elements containing biaxially oriented sheets in the base, the standard photofinishing machine cutters have difficulty in producing edges free of fibrous projections. Therefore, there is a need which is solved by this invention to provide a biaxially oriented sheet containing a imaging element that may be cut in the cross direction by conventional cutters.

In the photofinishing process it is necessary that the photofinishing machines punch index holes into the imaging element as it moves through the machine. Inaccurate or incomplete punching of these holes will lead to undesirable results, as the machine will not image the prints in the proper place. Further, failure to properly make index punches may lead to jamming, as prints may be cut to a size which the machine cannot handle. Since punching in imaging processing equipment usually occurs from the emulsion side, the fracture mechanism of bottom of the imaging element is a combination of cracks originating from both the punch and die. With tight clearances, as in a punch and die set with less than 1,000,000 actuations, the cracks, originating from the tool edges, miss each other and the cut is completed by a secondary tearing process producing a jagged edge approximately midway in bottom sheet thickness that is a function of punch and die clearance. As the punch and die begin to wear from repeated actuations, excessive clearance is formed allowing for extensive plastic deformation of the bottom sheet. When the crack finally forms, it can miss the opposing crack, separation is delayed and a long polymer burr can form in the punched hole. This long burr can cause unacceptable punched holes which can result in machine jams. For punching of the bottom biaxially oriented sheet of this invention, the energy to break is a significant factor in determining the quality of the punched index hole. Lowering the energy to break the bottom sheet for punching allows for punching fracture to occur at lower punch forces and aids in the reduction of punch burrs in the punched hole. The energy to break for the bottom polymer sheets of this invention is defined as the area under the stress strain curve. Energy to break is measured by running a simple tensile strength test for polymer sheets at a rate of 4000% strain per min.

For imaging materials that are chopped or for imaging materials that are punched with an index hole, energy to break of less than $3.5\times10^7$ J/m$^3$ for the bottom biaxially oriented sheet in at least one direction is preferred. A biaxially oriented polymer sheet with an energy to break greater than $4.0\times10^7$ J/m$^3$ does not show significant improvement in chopping or punching. For imaging coated paper that is chopped in photofinishing equipment, an energy to break of less than $3.5\times10^7$ J/m$^3$ in machine direction is preferred since the chopping usually occurs in the cross direction.

For imaging elements of this invention, the most preferred energy to break is between $9.0\times10^5$ J/m$^3$ and $3.5\times10^7$ J/m$^3$. Bottom polymer sheets with an energy to break less than $5.0\times10^5$ J/m$^3$ are expensive in that the process yield for oriented bottom sheets are reduced as lower orientation ratios are used to lower the energy to break. An energy to break greater than $4.0\times10^7$ J/m$^3$ does not show significant improvement for punching and chopping over cast low density polyethylene sheets that are commonly used as backside sheets in prior art imaging supports.

The preferred thickness of the biaxially oriented sheet should be from 12 to 50 $\mu$m. Below 12 $\mu$m, the sheets may not be thick enough to minimize any inherent nonplanarity in the support, would be more difficult to manufacture, and would not provide enough strength to provide curl resistance to a gel containing imaging layer such as a light sensitive silver halide emulsion. At thickness higher than 50 $\mu$m, little improvement in mechanical properties are seen, and so there is little justification for the further increase in cost for extra materials. Also at thickness greater than 50 $\mu$m, the force to punch an index hole in the photofinishing equipment is beyond the design force of some photofinishing equipment. Failure to complete a punch will result in machine jamming and loss of photofinishing efficiency.

The surface roughness of the backside sheet of this invention has two necessary surface roughness components to provide both efficient transport in photoprocessing equipment and writability and photoprocessing back marking. A combination of both low frequency roughness to provide efficient transport and high frequency roughness to provide a surface for printing and writing is preferred. High frequency surface roughness defined as having a spatial frequency greater than 500 cycles/mm with a median peak to valley height less than 1 $\mu$m. High frequency roughness is a determining factor in photofinishing back marking where valuable information is printed on the backside of an image and consumer backside writability where a variety of writing instruments such as pens and pencils are used to mark the backside of an image. High frequency roughness is measured using a Park Scientific M-5 Atomic Force multimodal scanning probe microscope. Data collection was accomplished by frequency modulation intermittent contact scanning microscopy in topography mode. The tip was an ultralevel 4:1 aspect ratio with an approximate radius of 100 Angstroms.

Low frequency surface roughness of backside biaxially oriented film or Ra is a measure of relatively finely spaced surface irregularities such as those produced on the backside of prior art imaging materials by the casting of polyethylene against a rough chilled roll. The low frequency surface roughness measurement is a measure of the maximum allowable roughness height expressed in units of micrometers and by use of the symbol Ra. For the irregular profile of the backside of imaging materials of this invention, the average peak to valley height, which is the average of the vertical distances between the elevation of the highest peak and that of the lowest valley, is used. Low frequency surface roughness, that is surface roughness that has spatial frequency between 200 and 500 cycles/mm with a median peak to valley height greater than 1 $\mu$m. Low frequency roughness is the determining factor in how efficiently the imaging element is transported through photofinishing equipment, digital printers, and manufacturing processes. Low frequency roughness is commonly measured by surface measurement device such as a Perthometer.

Biaxially oriented polyolefin sheets commonly used in the packaging industry are commonly melt extruded and then oriented in both directions (machine direction and cross direction) to give the sheet desired mechanical strength properties. The process of biaxial orientation generally creates a low frequency surface roughness of less than 0.23 $\mu$m. While the smooth surface has value in the packaging industry, use as a backside layer for imaging coated paper is limited. The preferred low frequency roughness for biaxially oriented sheets of this invention is between 0.30 and 2.00 $\mu$m. Laminated to the backside of the base coated paper, the biaxially oriented sheet must have a low frequency surface roughness greater than 0.30 $\mu$m to ensure efficient transport through the many types of photofinishing equipment that have been purchased and installed around the world. At a low frequency surface roughness less that 0.30 $\mu$m, transport through the photofinishing equipment becomes less efficient. At low frequency surface roughness greater than 2.54 $\mu$m, the surface would become too rough causing transport problems in photofinishing equipment, and the rough backside surface would also begin to emboss the silver halide emulsion as the material is wound in rolls.

The most preferred method of creating the desired low frequency roughness on the bottom most skin layer of a biaxially oriented sheet is to utilize an embossed oriented polymer sheet. The embossing process allows for the desired frequency and wave pattern to be incorporated into the imaging element. Smooth oriented polymer sheets are transported through a nip that contains a nip roll and an impression roll. Embossing preferably occurs as the oriented bottom sheet is exposed to a pattern roll under pressure and temperatures that exceed 120 degrees C. The critical factor controlling embossing is to reach the glass transitition temperature of the polymer so that the polymer accepts the pattern from the pattern roll.

The structure of a preferred backside biaxially oriented sheet of this invention wherein the skin layer is on the bottom of the imaging element is as follows:

Solid polypropylene core

Embossed polyethylene skin

The low frequency surface roughness of the skin layer can be accomplished by introducing addenda into the bottom most layer. The particle size of the addenda is preferably between 0.20 $\mu$m and 10 $\mu$m. At particles sizes less than 0.20 $\mu$m, the desired low frequency surface roughness cannot be obtained. At particles sizes greater than 10 $\mu$m, the addenda begins to create unwanted surface voids during the biaxially orientation process that would be unacceptable in a imaging coated paper application and would begin to emboss the silver halide emulsion as the material is wound in rolls. The preferred addenda to be added to the bottommost skin layer, to create the desired backside roughness, comprise a material selected from the group of inorganic particulates consisting of titanium dioxide, silica, calcium carbonate, barium sulfate, alumina, kaolin, and mixtures thereof. The addenda may also be cross-linked polymers beads using monomers from the group consisting of styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, polystyrene, or poly(methyl methacrylate).

Addenda may also be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

A random low frequency roughness pattern is preferred on the bottommost layer of the biaxially oriented sheet. A random pattern, or one that has no particular pattern, is preferred to an ordered pattern because the random pattern best simulates the appearance and texture of cellulose coated paper which adds to the commercial value of a imaging image. A random pattern on the bottommost skin layer will reduce the impact of the low frequency surface roughness transferring to the image side when compared to an ordered pattern. A transferred low frequency surface roughness pattern that is random is more difficult to detect than an ordered pattern.

The preferred high frequency roughness of biaxially oriented sheets of this invention is between 0.001 and 0.05 $\mu$m when measured with a high pass cutoff filter of 500 cycles/mm. High frequency roughness less than 0.0009 $\mu$m does not provide the required roughness for photofinishing back mark retention through wet chemistry processing of images. The high frequency roughness provides a nonuniform surface upon which the ink from the back mark, usually applied by a contact printer or ink jet printer, can adhere and be protected from the abrasion of photoprocessing. High frequency roughness greater than 0.060 $\mu$m does not provide the proper roughness for improved consumer writability with pens and pencils. Pens, much like the photoprocessing back mark, need a site for the pen ink to collect and dry. Pencils need a roughness to abrade the carbon from the pencil.

High frequency surface roughness of the backside sheet of this invention is accomplished by coating a separate layer on the skin which contains material that will produce the desired frequency of surface roughness, or by some combination of the two methods. Materials that will provide the desired high frequency of roughness include silicon dioxide, aluminum oxide, calcium carbonate, mica, kaolin, alumina, barium sulfate, titanium dioxide, and mixtures thereof. In addition, cross-linked polymer beads using styrene, butyl acrylamide, acrylonitrile, methy methacrylate, ethylene glycol dimethacrylate, vinyl pyridine, vinyl acetate, methyl acrylate, vinyl benzyl chloride, vinylidene chloride, acrylic acid, divinyl benzene, acrylamido methyl-propane, and polysiloxane resin may be used to form high frequency surface roughness of this invention. All these stated materials may be used in the skin layer, or as a coated layer, or in some combination thereof.

The preferred method by which the desired high frequency roughness may be created is through the application of a coated binder. The coated binder may be coated using a variety of methods known in the art to produce a thin, uniform coating. Examples of acceptable coating methods include gravure coating, air knife coating, application roll coating, or curtain coating. The coated binder may coated with or without a cross-linker that consists of a styrene acrylate, styrene butadiene methacrylate, styrene sulfonates, or hydroxy ethyl cellulose, or some mixture there of. These binders may be used alone to achieve the desired high frequency roughness, or combined with any of the particulates described above to achieve said roughness. The preferred class of binder materials consists of an addition product of from about 30 to 78 mol % of an alkyl methacrylate wherein the alkyl group has from 3 to 8 carbon atoms, from about 2 to about 10 mol % of an alkali metal salt of an ethylenically unsaturated sulfonic acid and from 20 to about 65 mol % of a vinyl benzene, the polymer having a glass transition point of from 30 to 65° C. When properly formulated, coated, and dried, the coalescence of the latex produces a high frequency roughness in combination with or without colloidal silica that is particularly useful for back marking and photofinishing back printing retention.

An example of a preferred material to provide the high frequency roughness is styrene butadiene methacrylate coated onto a biaxially oriented skin layer consisting of a copolymer of polyethylene and a terpolymer comprising ethylene, propylene, and butylene. The styrene butadiene methacrylate is coated at 25 grams/$m^2$ using gravure/backing coating roll system. The styrene butadiene methacrylate coating is dried to a surface temperature of 55° C. The biaxially oriented sheet of this example contains a low frequency component from the biaxially copolymer formulation and a high frequency component from the coated layer of styrene butadiene methacrylate.

In order to successfully transport an imaging coated paper that contains a laminated biaxially oriented sheet with the desired surface roughness on the opposite side of the image layer, an antistatic coating on the bottommost layer is preferred. The antistat coating may contain any known materials known in the art which are coated on imaging web materials to reduce static during the transport of imaging coated paper. The preferred surface resistivity of the antistat coating at 50% RH is less than $10^{13}$ ohm/square.

These biaxially oriented sheets may be coated or treated after the coextrusion and orienting process or between casting and full orientation with any number of coatings which may be used to improve the properties of the sheets for use in labeling including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

The preferred base is a imaging grade cellulose fiber coated paper.

In the case of silver halide imaging systems, suitable cellulose coated papers must not interact with the light sensitive emulsion layer. An imaging grade coated paper used in this invention must be "smooth" as to not interfere with the viewing of images. The surface roughness of cellulose coated paper or $R_a$ is a measure of relatively finely spaced surface irregularities on the coated paper. The surface roughness measurement is a measure of the maximum allowable roughness height expressed in units of micrometers and by use of the symbol $R_a$. For the coated paper of this invention, long wavelength surface roughness or orange peel is of interest. For the irregular surface profile of the coated paper of this invention, a 0.95 cm diameter probe is used to measure the surface roughness of the coated paper and, thus, bridge all fine roughness detail. The preferred surface roughness of the coated paper is between 0.13 and 0.44 $\mu$m. At surface roughness greater than 0.44 $\mu$m, little improvement in image quality is observed when compared to current imaging coated papers. A cellulose coated paper surface roughness less than 0.13 $\mu$m is difficult to manufacture and costly.

The preferred basis weight of the cellulose coated paper is between 117.0 and 195.0 g/$m^2$. A basis weight less than 117.0 g/$m^2$ yields an imaging support that does not have the required stiffness for transport through photofinishing equipment and digital printing hardware. Additionally, a basis weight less than 117.0 g/$m^2$ yields an imaging support that does not have the required stiffness for consumer acceptance. At basis weights greater than 195.0 g/$m^2$, the imaging support stiffness, while acceptable to consumers, exceeds the stiffness requirement for efficient photofinishing. Problems, such as the inability to be chopped and incomplete punches, are common with a cellulose coated paper that exceeds 195.0 g/$m^2$ in basis weight. The preferred fiber length of the coated paper of this invention is between 0.40 and 0.58 mm. Fiber Lengths are measured using a FS-200 Fiber Length Analyzer (Kajaani Automation, Inc.). Fiber lengths less than 0.35 mm are difficult to achieve in manufacturing and, as a result, expensive. Because shorter fiber lengths generally result in an increase in coated paper modulus, coated paper fiber lengths less than 0.35 mm will result in a imaging coated paper this is very difficult to punch in photofinishing equipment. Coated paper fiber lengths greater than 0.62 mm do not show an improvement in surface smoothness.

The preferred density of the cellulose coated paper is between 1.05 and 1.20 g/cc. A sheet density less than 1.05 g/cc would not provide the smooth surface preferred by consumers. A sheet density that is greater than 1.20 g/cc would be difficult to manufacture, requiring expensive calendering and a loss in machine efficiency.

The machine direction to cross direction modulus is critical to the quality of the imaging support, as the modulus ratio is a controlling factor in imaging element curl and a balanced stiffness in both the machine and cross directions. The preferred machine direction to cross direction modulus ratio is between 1.4 and 1.9. A modulus ratio of less than 1.4 is difficult to manufacture since the cellulose fibers tend to align primarily with the stock flow exiting the coated paper machine head box. This flow is in the machine direction and is only counteracted slightly by fourdrinier parameters. A modulus ratio greater than 1.9 does not provide the desired curl and stiffness improvements to the laminated imaging support.

A cellulose coated paper substantially free of $TiO_2$ may be formed in a low cost imaging reflective print as the opacity of the imaging support can be improved by laminating a microvoided biaxially oriented sheet to the cellulose coated paper of this invention. The elimination of $TiO_2$ from the cellulose coated paper for the low cost imaging coated paper significantly improves the efficiency of the coated paper making process, eliminating the need for cleaning unwanted $TiO_2$ deposits on critical machine surfaces.

For a premium imaging coated paper the use of $TiO_2$ in the coated paper base is preferred to improve the opacity of the imaging element. $TiO_2$ added to the coated paper base reduces unwanted transmission of ambient light which interferes with the viewing of images by consumers. The $TiO_2$ used may be either anatase or rutile type. Examples of $TiO_2$ that are acceptable for addition of cellulose coated paper are DuPont Chemical Co. R101 rutile $TiO_2$ and DuPont Chemical Co. R104 rutile $TiO_2$. Other pigments to improve imaging responses may also be used in this invention. Pigments such as talc, kaolin, $CaCO_3$, $BaSO_4$, ZnO, $TiO_2$, ZnS, and $MgCO_3$ are useful and may be used alone or in combination with $TiO_2$.

For an additional improvement in base coated paper opacity, the use of dyes in the coated paper base is preferred. The dyes added to the cellulose coated paper improves opacity, as the fiber and the dye in the coated paper each absorbs and scatters light independently of each other, and the opacifying effects are additive. The preferred opacifying dye added to the cellulose coated paper is a blue dye. Blue dyes are preferred, as they have been shown to provide high opacity and are perceived by the consumer as acceptable, as consumers prefer blue-white coated papers to yellow-white or green-white coated papers. Blue dye may also be used in combination with $TiO_2$, as the opacity effects of the $TiO_2$ and blue dye have been shown to be additive and produce a cellulose coated paper base that is high in opacity.

A cellulose coated paper substantially free of dry strength resin and wet strength resin is preferred because the elimination of dry and wet strength resins reduces the cost of the cellulose coated paper and improves manufacturing efficiency. Dry strength and wet strength resins are commonly added to cellulose imaging coated paper to provide strength in the dry state and strength in the wet state, as the coated paper is developed in wet processing chemistry during the photofinishing of consumer images. In this invention, dry and wet strength resin are no longer needed as the strength of the imaging support is the result of laminating high strength biaxially oriented polymer sheets to the top and bottom of the cellulose coated paper.

Any pulps known in the art to provide image quality coated paper may be used in this invention. Bleached hardwood chemical kraft pulp is preferred as it provides brightness, a good starting surface, and good formation, while maintaining strength. In general, hardwood fibers are much shorter than softwood by approximately a 1:3 ratio. Pulp with a brightness less than 90% Brightness at 457 nm is preferred. Pulps with brightness of 90% or greater are commonly used in imaging supports because consumers typically prefer a white coated paper appearance. A cellulose coated paper less than 90% Brightness at 457 nm is preferred, as the whiteness of the imaging support can be improved by laminating a microvoided biaxially oriented sheet to the cellulose coated paper of this invention. The reduction in brightness of the pulp allows for a reduction in the amount of bleaching required, thus lowering the cost of the pulp and reducing the bleaching load on the environment.

Calcium carbonate is a preferred filler for the cellulose coated base of this invention. Calcium carbonate as a filler presents many advantages. It is not photographically active. It is compatible with the use of optical brightening agents. It can be manufactured to exacting specifications in size, shape, and purity. It is of low cost. However, calcium carbonate decomposes at acidic pH's limiting its use severely. For example, the use of calcium carbonate as a filler is typically limited to alkaline paper-making operations since calcium carbonate is known to decompose to calcium hydroxide and carbon dioxide when exposed to the acidic pH of acid paper-making operations. In photographic paper, in particular, the paper is exposed to developer solutions that typically are of pH 3.0. Any calcium carbonate present in the paper that is exposed to the developer solution is decomposed causing calcium ions to exit the paper and enter the developer solution bath. Over time, the calcium ion concentration within the developer builds until calcium precipitates in the form of a salt, forming stalagmites within the developer solution batch. These stalagmites rub against the moving paper web causing scratches that render the resulting prints unusable. The use of calcium carbonate in photographic paper, otherwise desirable because of the improved smoothness and opacity imparted to the sheet, is thus prohibited.

The calcium carbonate used may be either precipitated or ground. Examples of $CaCO_3$ that are acceptable for addition to the cellulose paper of this invention include the family of precipitated calcium carbonates sold under the tradenames Albacar, Albalfil, and Albagloss by Specialty Minerals, Inc. and the family of ground calcium carbonates sold under the tradenames Omyafil and Omyapaque by Omya, Inc and, in particular, Albacar HO made by Specialty minerals, Inc. and Omyafil made by Omya, Inc.

The smooth, strong paper of the invention may also contain $TiO_2$. $tiO_2$ has been shown to improve the opacity of the paper and provide a high quality white appearance. $TiO_2$ and calcium carbonate may also be used in combination. The preferred ratio of calcium carbonate addition to $TiO_2$ addition is between 2:1 and 6:1. Below a 2:1 ratio, the manufacturing and cost advantages of calcium carbonate are reduced. Above a 7:1 ratio, little improvement in paper whiteness or opacity is observed to justify the additional expense of the $TiO_2$. The most preferred ratio of calcium carbonate addition to $TiO_2$ addition is 4:1. At a 4:1 ratio, the opacity, cost and whiteness have been found to be optimized for silver halide imaging systems.

The $TiO_2$ used in combination with the calcium carbonate may be either anatase or rutile type. Examples of $TiO_2$ that are acceptable for addition of cellulose paper are Dupont Chemical Co. R101 rutile $TiO_2$ and DuPont Chemical Co. R104 rutile $TiO_2$. Other pigments to improve photographic responses may also be used in this invention, pigments such as talc, kaolin, $BASO_4$, ZnO, $TiO_2$, ZnS, and $MgCO_3$ are useful and may be used alone or in combination with $TiO_2$.

The coated base paper to be used as the support for the laminated photographic printing paper of this invention may be selected from materials conventionally used in photographic printing paper. These include natural cellulose wood pulp. The pulps typically are a blend or hardwood and softwoods to provide a balance between mechanical strengths and overall surface smoothness. A photographic paper support is typically produced by refining a pulp furnish of 50% bleached hardwood Kraft, 25% bleached hardwood sulfite, and 25% bleached softwood sulfite through a double disk refiner, then a Jordan conical refiner to a Canadian Standard Freeness of 200 cc. To the resulting pulp furnish is treated with alkyl Ketene dimmer, cationic cornstarch, polyamide-epichlorohydrin, anionic polyacrylamide, and $TiO_2$ on a dry weight basis.

In the course of making a photographic element the coated paper base in a preferred embodiment is coated with a surface size comprising starch dispersion that may also contain salts, optical brighteners, antioxidants and other materials. It is commonly known in the paper industry to apply pigmented size dispersion via a metering or gate roll size press or by an inline coater such as blade or metering rod coater: Such pigmented dispersion typically contains either hydrophilic or hydrophobic binders with a white pigment. Typical hydrophilic binders may include starch, gelatin, polyvinyl alcohol, water dispersible polyurethanes and polyesters or other material known in the art. White pigments typically may include $TiO_2$, $BaSO_4$, ZnS, Clays, Talcs or $CaCO_3$. These materials are formulated to meet the requirements of the particular method of application. While the addition of pigmented coating and size dispersion inline on a paper machine appear to be economically, many problem are encountered when latexes and other materials are added to the paper sheet. It becomes very difficult to repulp or reuse the paper once a latex type binder has been added and dried on the sheet. Furthermore if there is a problem with either the paper forming part of the process or with the coating application part of the process, then the either process must be shutdown resulting in excessive waste and downtime. When looking at the economics of such a combined process, it may be better to apply any coating offline as part of a separate operation.

If the coating operation is done as a separate operation, more focus can be provided to the particular problems that may be encountered with a coating operation as opposed to a paper making process. The selection of binder suitable for an offline coating operation may also be expanded. Hydrophobic binder typically used may include addition-type polymers and interpolymers prepared from ethylenically unsaturated monomers which include acrylates and methacrylates such as methyl acrylate, ethyl acrylate, butyl acrylate, hexyl acrylate, n-octyl acrylate, 2-ethylhexyl acrylate, nonyl acrylate, benzyl acrylate, lauryl acrylate, methyl methacrylate, ethyl methacrylate, butyl methcrylate, hexyl methacrylate, n-octyl methacrylate, 2-ethylhexyl methacrylate, nonyl methacrylate, benzyl methacrylate, lauryl methacrylate, dialkyl itaconates, dialkyl maleates, acrylonitrile and methacrylonitrile, styrenes including substituted styrenes, vinyl acetates, vinyl ethers, vinyl and vinylidene halides, and olefins such as butadiene and isoprene. These include latexes such as styrene-butadiene, polyacrylate, methyl methacrylate-butadiene latex, copolymers of styrene-acrylic and other latexes known in the art. These polymers may applied from organic solvent or aqueous media and may contain reactive functional groups capable of forming covalent bonds by intermolecular crosslinking or by reaction with a crosslinking agent (i.e., a hardener). Suitable reactive functional groups include hydroxyl, carboxyl, carbodiimide, amino, amide, allyl, epoxide, aziridine, vinyl sulfone, sulfinic acid, and active methylene.

A variety of methods of application may be used to apply or to impregnate the sheet or to apply a layer on the sheet. The most preferred methods are blade coating or curtain application in which more than one discrete layer may be applied to the sheet. With a curtain application of more than one layer, individual functionality may be build into each layer. In this way the layers may be optimized for adhesion to the base, loading of pigment or other functional chemistry or a top gloss or holdout layer. Blade or rod applications are desirable for a single layer coating that may be applied at relatively high solids which helps to minimize the drying load. Other acceptable methods may include roller coater, gate roll presses or coaters, billbade coaters that as the capability of applying different solution to the each side of the sheet, or air knife. After the coating has been applied, it is know in the art to dry or drive off the solvent phase of the coating dispersion. This is done by hot air impingement, or IR driers or a combination thereof. In a typically coated paper application and in particular an inline coating process on a paper making machine, it is very common to calander the sheet to provide enhanced smoothness and surface qualities.

For the formation of cellulose coated paper of sufficient smoothness, it is desirable to rewet the coated paper surface prior to final calendering. Coated papers made on the coated paper machine with a high moisture content calendar much more readily that coated papers of the same moisture content containing water added in a remoistening operation. This is due to a partial irreversibility in the imbition of water by cellulose. However, calendering a coated paper with high moisture content results in blackening, a condition of transparency resulting from fibers being crushed in contact with each other. The crushed areas reflect less light and, therefore, appear dark, a condition that is undesirable in an imaging application such as a base for color coated paper. By adding moisture to the surface of the coated paper after the coated paper has been machine dried, the problem of blackening can be avoided while preserving the advantages of high moisture calendering. The addition of surface moisture prior to machine calendering is intended to soften the surface fibers and not the fibers in the interior of the coated paper. Coated papers calendered with a high surface moisture content generally show greater strength, higher surface density, and image gloss, all of which are desirable for an imaging support and all of which have been shown to be perceptually preferred to prior art imaging coated paper bases.

There are several coated paper surface humidification/moisturization techniques. The application of water, either by mechanical roller or aerosol mist by way of an electrostatic field, are two techniques known in the art. The above techniques require dwell time, hence web length, for the water to penetrate the surface and equalize in the top surface of the coated paper. Therefore, it is difficult for these above systems to make moisture corrections without distorting, spotting, and swelling of the coated paper. The preferred method to rewet the coated paper surface prior final calendering is by use of a steam shower. A steam shower uses saturated steam in a controlled atmosphere to cause water vapor to penetrate the surface of the coated paper and condense. Prior to calendering, the steam shower allows a considerable improvement in gloss and smoothness due to the heating up and moisturizing the coated paper of this invention before the pressure nip of the calendering rolls. An example of a commercially available system that allows for controlled steam moisturization of the surface of cellulose coated paper is the "Fluidex System" manufactured by Pagendarm Corp.

For imaging supports, the use of a steam on the face side of the coated paper only is preferred since improved surface smoothness has commercial value for the imaging side of the coated paper. Application of the steam shower to both sides of the coated paper, while feasible, is unnecessary and adds additional cost to the product.

The preferred moisture content by weight after applying the steam and calendering is between 7% and 9%. A moisture level less than 7% is more costly to manufacture since more fiber is needed to reach a final basis weight. At a moisture level greater than 10% the surface of the coated paper begins to degrade. After the steam shower rewetting of the coated paper surface, the coated paper is calendered before winding of the coated paper. The preferred temperature of the calender rolls is between 76° C. and 88° C. Lower temperatures result in a poor surface. Higher temperatures are undesirable, as they require more energy and have been found to increase coated paper moisture variability during winding.

When using a cellulose fiber coated paper support, it is preferable to extrusion laminate the oriented polymer composite sheets to the base coated paper using a polyolefin resin. Extrusion laminating is carried out by bringing together the biaxially oriented sheets of the invention and the base coated paper with application of an adhesive between them, followed by their being pressed in a nip such as between two rollers. The adhesive may be applied to either the biaxially oriented sheets or the base coated paper prior to their being brought into the nip. In a preferred form the adhesive is applied into the nip simultaneously with the biaxially oriented sheets and the base coated paper.

The bonding agent used for bonding biaxially oriented sheets to cellulose imaging coated paper is preferably selected from a group of resins that can be melt extruded at about 160° C. to 300° C. Usually, a polyolefin resin such as polyethylene or polypropylene is used.

Adhesive resins are preferred for bonding biaxially oriented sheets to imaging grade cellulose coated paper over polyethylene. An adhesive resin used in this invention is one that can be melt extruded and provide sufficient bond strength between the cellulose coated paper and the biaxially oriented sheet. For use in the conventional imaging system, peel forces between the coated paper and the biaxially oriented sheets need to be greater than 150 grams/5 cm to prevent delamination during the manufacture of the imaging base, during processing of an image, or in the final image format. "Peel strength" or "separation force" or "peel force" is the measure of the amount of force required to separate the biaxially oriented sheets from the base coated paper. Peel strength is measured using an Instron gauge and the 180 degree peel test with a cross head speed of 1.0 meters/min. The sample width is 5 cm and the distance peeled is 10 cm.

In the case of a silver halide imaging system, suitable adhesive resins must also not interact with the light sensitive emulsion layer. Preferred examples of adhesive resins are ionomer (e.g., an ethylene metharylic acid copolymer cross linked by metal ions such as Na ions or Zn ions), ethylene vinyl acetate copolymer, ethylene methyl methacrylate copolymer, ethylene ethyl acrylate copolymer, ethylene methyl acrylate copolymer, ethylene acrylic acid copolymer, ethylene ethyl acrylate maleic anhydride copolymer, or ethylene methacrylic acid copolymer. These adhesive resins are preferred because they can be easily melt extruded and provide peel forces between biaxially oriented polyolefin sheets and base coated paper greater than 150 grams/5 cm.

Metallocene catalyzed polyolefin plastomers are most preferred for bonding oriented polyolefin sheets to imaging base coated paper because they offer a combination of excellent adhesion to smooth biaxially oriented polyolefin sheets, are easily melt extruded using conventional extrusion equipment, and are low in cost when compared to other adhesive resins. Metallocenes are class of highly active olefin catalysts that are used in the preparation of polyolefin plastomers. These catalysts, particularly those based on group IVB transition metals such as zirconium, titanium, and hafnium, show extremely high activity in ethylene polymerization. Various forms of the catalyst system of the metallocene type may be used for polymerization to prepare the polymers used for bonding biaxially oriented polyolefin sheets to cellulose coated paper. Forms of the catalyst system include, but are not limited to, those of homogeneous, supported catalyst type, high pressure process or a slurry or a solution polymerization process. The metallocene catalysts are also highly flexible in that, by manipulation of catalyst composition and reaction conditions, they can be made to provide polyolefins with controllable molecular weights. Suitable polyolefins include polypropylene, polyethylene, polymethylpentene, polystyrene, polybutylene, and mixtures thereof. Development of these metallocene catalysts for the polymerization of ethylene is found in U.S. Pat. No. 4,937,299 (Ewen et al).

The most preferred metallcoene catalyzed copolymers are very low density polyethylene (VLDPE) copolymers of ethylene and a $C_4$ to $C_{10}$ alpha monolefin, most preferably copolymers and terpolymers of ethylene and butene-1 and hexene-1 . The melt index of the metallocene catalyzed ethylene plastomers preferably fall in a range of 2.5 g/l min to 27 g/10 min. The density of the metallocene catalyzed ethylene plastomers preferably falls in a range of 0.8800 to 0.9100. Metallocene catalyzed ethylene plastomers with a density greater than 0.9200 do not provide sufficient adhesion to biaxially oriented polyolefin sheets.

Melt extruding metallocene catalyzed ethylene plastomers presents some processing problems. Processing results from earlier testing in food packaging applications indicated that their coating performance, as measured by the neck-in to draw-down performance balance, was worse than conventional low density polyethylene, making the use of metallocene catalyzed plastomers difficult in a single layer melt extrusion process that is typical for the production of current imaging support. By blending low density polyethylene with the metallocene catalyzed ethylene plastomer, acceptable melt extrusion coating performance was obtained, making the use of metallocene catalyzed plastomers blended with low density polyethylene (LDPE) very efficient. The preferred level of low density polyethylene to be added is dependent on the properties of the LDPE used (properties such as melt index, density, and type of long chain branching) and the properties of the metallocene catalyzed ethylene plastomer selected. Since metallocene catalyzed ethylene plastomers are more expensive than LDPE, a cost to benefit trade-off is necessary to balance material cost with processing advantages, such as neck-in and product advantages such as biaxially oriented film adhesion to coated paper. In general the preferred range of LDPE blended is 10% to 80% by weight.

The bonding layer may also contain pigments which are known to improve the imaging responses such as whiteness or sharpness. Titanium dioxide is preferred and used in this invention to improve image sharpness. The $TiO_2$ used may be either anatase or rutile type. In the case of whiteness, anatase is the preferred type. In the case of sharpness, rutile is the preferred. Further, both anatase and rutile $TiO_2$ may be blended to improve both whiteness and sharpness. Examples of $TiO_2$ that are acceptable for a imaging system are DuPont Chemical Co. R101 rutile $TiO_2$ and DuPont Chemical Co. R104 rutile $TiO_2$. Other pigments to improve imaging responses may also be used in this invention. Examples of other white pigments include talc, kaolin, $CaCO_3$, $BaSO_4$, ZnO, $TiO_2$, ZnS, and $MgCO_3$. The preferred weigh percent of $TiO_2$ added to the bonding layer is between 12% and 18%. The addition of $TiO_2$ less than 8% does not significantly impact the optical performance of the image. $TiO_2$ greater than 24% decreases manufacturing efficiency, as problems such as extrusion pigment die lines are encountered.

The bonding layer may also contain addenda known in the art to absorb light. A light absorbing layer in this invention is used to improve optical properties of an image, properties such as opacity and image resolution. An example of a light absorbing material and can be added to the bonding layer is an extrusion grade of carbon black. Carbon black addenda are produced by the controlled combustion of liquid hydrocarbons and can be added to the bonding layer prior to melt extrusion.

In the manufacturing process for this invention, preferred bonding agents are melt extruded from a slit die. In general, a T die or a coat hanger die are preferably used. The melt temperature of the preferred bonding agent is 240° C. to 325° C. Extrusion lamination is carried out by bringing together the biaxially oriented sheet and the base coated paper with application of the bonding agent between the base coated paper and the biaxially oriented sheet followed by their being pressed together in a nip such as between two rollers. The total thickness of the bonding layer can range from 2.5 μm to 25 μm, preferably from 3.8 μm to 13 μm. Below 3.8 μm it is difficult to maintain a consistent melt extruded bonding layer thickness. At thickness higher than 13 μm there is little improvement in biaxially oriented sheet adhesion to coated paper.

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and back side film to keep curl to a minimum.

Used herein, the phrase 'imaging element' comprises an imaging support as described above along with an image receiving layer as applicable to multiple techniques governing the transfer of an image onto the imaging element. Such techniques include thermal dye transfer, electrophotographic printing, or ink jet printing, as well as a support for photographic silver halide images. As used herein, the phrase "photographic element" is a material that utilizes photosensitive silver halide in the formation of images. While this invention is directed towards a photographic recording element comprising a support and at least one light sensitive silver halide emulsion layer comprising silver halide grains; images that are formed utilizing ink jet printing, thermal dye transfer printing and electrophotographic printing are also valuable. In particular, the above mentioned printing technologies do not require a separate printing and chemical development process and are capable of printing images from a digital file which allows digital printing of packaging pressure sensitive labels.

The thermal dye image-receiving layer of the receiving elements of the invention may comprise, for example, a polycarbonate, a polyurethane, a polyester, polyvinyl chloride, poly(styrene-co-acrylonitrile), poly(caprolactone), or mixtures thereof. The dye image-receiving layer may be present in any amount that is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention, provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803, and 5,023,228. As noted above, dye-donor elements are used to form a dye transfer image. Such a process comprises image-wise-heating a dye-donor element and transferring a dye image to a dye-receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye and the dye transfer steps are sequentially performed for each color to obtain a three-color dye transfer image. When the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form, the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the toner particle. Heating both removes residual liquid and fixes the toner to paper.

When used as ink jet imaging media, the recording elements or media typically comprise a substrate or a support material having on at least one surface thereof an ink-receiving or image-forming layer. If desired, in order to improve the adhesion of the ink receiving layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, can be applied to the surface of the support. The ink receiving layer is preferably coated onto the support layer from water or water-alcohol solutions at a dry thickness ranging from 3 to 75 micrometers, preferably 8 to 50 micrometers.

Any known ink jet receiver layer can be used in combination with the external polyester-based barrier layer of the present invention. For example, the ink receiving layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like; derivatives of natural polymers such as functionalized proteins, functionalized gums and starches, and cellulose ethers and their derivatives; and synthetic polymers such as polyvinyloxazoline, polyvinylmethyloxazoline, polyoxides, polyethers, poly(ethylene imine), poly(acrylic acid), poly (methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer can be overcoated with an ink-permeable, anti-tack protective layer such as, for example, a layer comprising a cellulose derivative or a cationically-modified cellulose derivative or mixtures thereof. An especially preferred overcoat is poly β-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water-based inks. The overcoat layer can also protect the ink receiving layer from abrasion, smudging, and water damage. In general, this overcoat layer may be present at a dry thickness of about 0.1 to about 5 μm, preferably about 0.25 to about 3 μm.

In practice, various additives may be employed in the ink receiving layer and overcoat. These additives include surface active agents such as surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating, and the like. Some of these methods allow for simultaneous coatings of both layers, which is preferred from a manufacturing economic perspective.

The DRL (dye receiving layer) is coated over the tie layer or TL at a thickness ranging from 0.1–10 μm, preferably 0.5–5 μm. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166; 5,264,275; 5,104,730; 4,879,166, and Japanese Patents 1,095,091; 2,276,671; 2,276,670; 4,267,180; 5,024,335, and 5,016,517 disclose aqueous based DRL formulations comprising mixtures of psuedo-bohemite and certain water soluble resins. Light in U.S. Pat. Nos. 4,903,040; 4,930,041; 5,084,338; 5,126,194; 5,126,195; and 5,147,717 discloses aqueous-based DRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable DRL formulations based on poly(vinyl alcohol). Iqbal in U.S. Pat. No. 5,208,092 discloses water-based IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is 0.1–10 micrometers thick and is coated as an aqueous dispersion of 5 parts alumoxane and 5 parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

Ink jet receiver coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

An example of a preferred ink jet coating solution was prepared by combining alumina, poly(vinyl alcohol) and 2,3-dihydroxy-1,4-dioxane in a ratio of 88:10:2 to give an aqueous coating formulation of 30% solids by weight. The formulation was bead-coated at 40° C. on polyethylene-coated paper base which had been previously subjected to corona discharge treatment. The coating was then dried at 60° C. by forced air to yield a recording element having a thickness of 40 $\mu$m (43 g/m$^2$).

Smooth opaque paper bases are useful in combination with silver halide images because the contrast range of the silver halide image is improved, and show through of ambient light during image viewing is reduced. The preferred photographic element of this invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100$\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. This invention in a preferred embodiment utilizes a radiation-sensitive emulsion comprised of silver halide grains (a) containing greater than 50 mole percent chloride based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula:

$$[ML_6]^n \quad \text{(I)}$$

wherein n is zero, −1, −2, −3, or −4; M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand; and (ii) an iridium coordination complex containing a thiazole or substituted thiazole ligand. Preferred photographic imaging layer structures are described in EP Publication 1 048 977. The photosensitive imaging layers described therein provide particularly desirable images on the pragmatic sheet of this invention. Further, gelatin emulsion tinting may be used to offset the native yellowness of the gelatin and provide a neutral white position. The preferred emulsion tinting method is disclosed in U.S. Pat. No. 6,180,330.

In order to utilize the imaging element of the invention for a label material, the image is preferably protected with an environmental protection layer. The environmental protection layer may consist of suitable material that protects the image from environmental solvents, resists scratching, and does not interfere with the image quality. The environmental protection layer is preferably applied to the photographic image after image development because the liquid processing chemistry required for image development must be able to efficiently penetrate the surface of the imaging layers to contact the silver halide and couplers utilizing typical silver halide imaging processes. The environmental protection layer would be generally impervious to developer chemistry. An environmental protection layer where transparent polymer particles are applied to the topmost surface of the imaging layers in the presence of an electric field and fused to the topmost layer causing the transparent polymer particles to form a continuous polymeric layer is preferred. An electrophotographic toner applied polymer is preferred, as it is an effective way to provide a thin, protective environmental layer to the photographic label that has been shown to withstand environmental solvents and damage due to handling.

In another embodiment, the environmental protection layer is coatable from aqueous solution, which survives exposure and processing, and forms a continuous, water-impermeable protective layer in a post-process fusing step. The environmental protection layer is preferably formed by coating polymer beads or particles of 0.1 to 50 $\mu$m in average size together with a polymer latex binder on the emulsion side of a sensitized photographic product. Optionally, a small amount of water-soluble coating aids (viscosifiers, surfactants) can be included in the layer, as long as they leach out of the coating during processing. After exposure and processing, the product with image is treated in such a way as to cause fusing and coalescence of the coated polymer beads, by heat and/or pressure (fusing), solvent treatment, or other means so as to form the desired continuous, water impermeable protective layer.

Examples of suitable polymers from which the polymer particles used in environmental protection layer can be selected include poly(vinyl chloride), poly(vinylidene chloride), poly(vinyl chloride-co-vinylidene chloride), chlorinated polypropylene, poly(vinyl chloride-co-vinyl acetate), poly(vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, dammar gum, ketone resins, maleic acid resins, vinyl polymers, such as polystyrene and polyvinyltoluene or copolymer of vinyl polymers with methacrylates or acrylates, poly(tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly(methyl methacrylate), copolymers with siloxanes and polyalkenes. These polymers can be used either alone or in combination. In a preferred embodiment of the invention, the polymer comprises a polyester or poly (styrene-co-butyl acrylate). Preferred polyesters are based on ethoxylated and/or propoxylated bisphenol A and one or more of terephthalic acid, dodecenylsuccinic acid and fumaric acid as they form an acceptable environmental protection layer that generally survives the rigors of a packaging label.

To increase the abrasion resistance of the environmental protection layer, polymers which are cross-linked or branched can be used. For example, poly(styrene-co-indene-co-divinylbenzene), poly(styrene-co-acrylonitrile-co-divinylbenzene), or poly(styrene-co-butadiene-co-divinylbenzene) can be used.

The polymer particles for the environmental protection layer should be transparent, and are preferably colorless. But it is specifically contemplated that the polymer particle can have some color for the purposes of color correction, or for special effects, so long as the image is viewable through the overcoat. Thus, there can be incorporated into the polymer particle dye which will impart color. In addition, additives can be incorporated into the polymer particle which will give to the overcoat desired properties. For example, a UV absorber can be incorporated into the polymer particle to make the overcoat UV absorptive, thus protecting the image from UV induced fading or blue tint can be incorporated into the polymer particle to offset the native yellowness of the gelatin used in the silver halide imaging layers.

In addition to the polymer particles which form the environmental protection layer, there can be combined with the polymer composition other particles which will modify the surface characteristics of the element. Such particle are solid and nonfusible at the conditions under which the polymer particles are fused, and include inorganic particles, like silica, and organic particles, like methylmethacrylate beads, which will not melt during the fusing step and which will impart surface roughness to the overcoat.

The surface characteristics of the environmental protection layer are in large part dependent upon the physical characteristics of the polymer which forms the toner and the presence or absence of solid, nonfusible particles. However, the surface characteristics of the overcoat also can be modified by the conditions under which the surface is fused. For example, the surface characteristics of the fusing member that is used to fuse the toner to form the continuous overcoat layer can be selected to impart a desired degree of smoothness, texture or pattern to the surface of the element. Thus, a highly smooth fusing member will give a glossy surface to the imaged element, a textured fusing member will give a matte or otherwise textured surface to the element, a patterned fusing member will apply a pattern to the surface of the element.

Suitable examples of the polymer latex binder include a latex copolymer of butyl acrylate, 2-acrylamido-2-methylpropanesulfonate, and acetoacetoxyethylmethacrylate. Other latex polymers which are useful include polymers having a 20 to 10,000 nm diameter and a Tg of less than 60° C. suspended in water as a colloidal suspension.

Examples of suitable coating aids for the environmental protection layer include any water soluble polymer or other material that imparts appreciable viscosity to the coating suspension, such as high MW polysaccharide derivatives (e.g. xanthan gum, guar gum, gum acacia, Keltrol (an anionic polysaccharide supplied by Merck and Co., Inc.) high MW polyvinyl alcohol, carboxymethylcellulose, hydroxyethylcellulose, polyacrylic acid and its salts, polyacrylamide, etc). Surfactants include any surface active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The application of an ultraviolet polymerizable monomers and oligomers to the outermost layer of the developed silver halide imaging layers and subsequent radiation exposure to form a thin cross-linked protective layer is preferred. UV cure polymers are preferred, as they can easily be applied to the outermost layer of the silver halide imaging layers and have been shown to provide an acceptable protective layer for the silver halide label material. Preferred UV cure polymers include aliphatic urethane, allyl methacrylate, ethylene glycol dimethacrylate, polyisocyanate and hydroxyethyl methacrylate. A preferred photoinitiator is benzil dimethyl ketal. The preferred intensity of radiation is between 0.1 and 1.5 milliwatt/cm$^2$. Below 0.05, insufficient cross-linking occurs yielding a protective layer that does not offer sufficient protection for the labeling of packages.

The application of a pre-formed polymer layer to the outermost surface of the developed label silver halide image to form an environmental protection layer is most preferred. Application of a pre-formed sheet is preferred because pre-formed sheets are tough and durable and therefore easily withstand the environmental solvents and handling forces applied to the silver halide imaged label. Application of the pre-formed polymer sheet is preferable carried out though lamination after image development. An adhesive is applied to either the photographic label or the pre-formed polymer sheet prior to a pressure nip that adheres the two surfaces and eliminates any trapped air that would degrade the quality of the image.

The pre-formed sheet preferably is an oriented polymer because of the strength and toughness developed in the orientation process. Preferred polymers for the flexible substrate include polyolefins, polyester and nylon. Preferred polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is most preferred, as it is low in cost and has desirable strength and toughness properties required for a pressure sensitive label.

The application of a synthetic latex to the developed silver halide label image is another preferred environmental protection layer. A coating of synthetic latex has been shown to provide an acceptable environmental protection layer and can be coated in an aqueous solution eliminating exposure to solvents. The coating of latex has been shown to provide an acceptable environmental protection layer for the silver halide packaging label. Preferred synthetic latexes for the environmental protection layer are made by emulsion polymerization techniques from styrene butadiene copolymer, acrylate resins, and polyvinyl acetate. The preferred particles size for the synethetic latex ranges from 0.05 to 0.15 $\mu$m. The synthetic latex is applied to the outermost layer of the silver halide imaging layers by known coating methods that include rod coating, roll coating and hopper coating. The synthetic latexes must be dried after application and must dry transparent so as not to interfere with the quality of the silver halide image.

The following examples illustrate the practice of this invention. They are not intended to be exhaustive of all possible variations of the invention. Parts and percentages are by weight unless otherwise indicated.

EXAMPLES

Example 1

In this example a photographic element was constructed by laminating biaxially oriented sheets to the top and bottom of a coated cellulose photographic grade paper. The invention was compared to a prior art photographic element utilizing voided biaxially oriented sheet laminated to a typical photographic base paper. This example will show that the invention materials are improved for creasing compared to the control. This example will also demonstrate the ability to utilize the photographic element of the invention for a glue applied silver halide image.

The following is a description of photographic element A (invention) and was prepared by extrusion laminating the following top and bottom biaxially oriented sheet to the cellulose paper described below:

Top Sheet (Emulsion Side)

A composite sheet consisting of 3 layers identified as L1, L2, L3. L1 is the thin clear layer on the outside of the package to which the photosensitive silver halide layer was attached. L2 is the layer to which $TiO_2$ was added. The rutile $TiO_2$ used was DuPont R1104 (a 0.22 $\mu$m particle size $TiO_2$). Table 1 below lists the characteristics of the layers of the top biaxially oriented sheet used in this example.

Bottom Sheet (Backside)

The bottom biaxially oriented sheet laminated to the backside of photographic base A was a both sides treated with corona discharge, biaxially oriented polypropylene sheet (19.1 $\mu$m thick) (d=0.90 g/cc) consisting of a solid oriented polypropylene core and two high energy surface obtained by corona treatment at 4 J/m$^2$ treatment level for lamination. The backside roughness (0.98 um) was obtained by embossing the above biaxially oriented polypropylene sheet during the lamination process using a 1.63 um embossing roll.

TABLE 1

| Layer | Material | Thickness, $\mu$m |
|---|---|---|
| L1 | MD Polyethylene | 1.27 |
| L2 | Polypropylene + 8% $TiO_2$ | 15.24 |
| L3 | Clear Polypropylene | 1.27 |

Photographic Grade Cellulose Paper Base Used to Construct Photographic Element A (Invention)

Paper base was produced for photographic element A using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber Lengths from the slurry were measured using a FS-200 Fiber Length Analyzer (Kajaani Automation Inc.). Energy applied to the fibers indicated by the total Specific Net Refining Power (SNRP) was 115 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20%), and sodium bicarbonate. Surface sizing using hydroxyethylated starch and sodium chloride was also employed but is not critical to the invention. In the 3$^{rd}$ Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.06 moisture levels after the calender was 7.0% to 9.0% by weight. Paper base A was produced at a basis weight of 117 g/m$^2$ and thickness of 0.1070 mm. Paper base A was blade coated with an acrylic latex at a coverage of 6.5 g/m$^2$.

The top and bottom sheets used in this example was coextruded and biaxially oriented. The top sheet was melt extrusion laminated to the above cellulose paper base using a metallocene catalyzed ethylene plastomer (SLP 9088) manufactured by Exxon Chemical Corp. The metallocene catalyzed ethylene plastomer had a density of 0.900 g/cc and a melt index of 14.0.

The following is a description of photographic element B (control) and was prepared by extrusion laminating the following top and bottom biaxially oriented sheet to the cellulose paper described below:

Top Sheet (Emulsion Side)

A composite sheet consisting of 5 layers identified as L1, L2, L3, L4, and L5. L1 is the thin colored layer on the outside of the package to which the photosensitive silver halide layer was attached. L2 is the layer to which optical brightener and $TiO_2$ was added. The optical brightener used was Hostalux KS manufactured by Ciba-Geigy. A coated extrusion grade anatase $TiO_2$ was added to both L2 and L4. Table 3 below lists the characteristics of the layers of the top biaxially oriented sheet used in this example.

Bottom Sheet (Backside)

The bottom biaxially oriented sheet laminated to the backside of photographic base B was a one-side matte finish, one-side corona treated biaxially oriented polypropylene sheet (25.6 um thick) (d=0.90 g/cc) consisting of a solid oriented polypropylene layer and a skin layer of block copolymer of polyethylene and a terpolymer comprising ethylene, propylene, and butylene corona treatment was at a 4 J/m$^2$ treatment level. The skin layer was on the bottom and the polypropylene layer and laminated to paper.

TABLE 3

| Layer | Material | Thickness, $\mu$m |
|---|---|---|
| L1 | LD Polyethylene + color concentrate | 0.75 |
| L2 | Polypropylene + 24% $TiO_2$ + OB | 6.65 |
| L3 | Voided Polypropylene | 21 |
| L4 | Polypropylene + 18% $TiO_2$ | 6.85 |
| L5 | Polypropylene | 0.76 |

Photographic Grade Cellulose Paper Base Used in Photographic Element B (Control)

Paper base was produced for photographic element B using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber Lengths from the slurry were measured using a FS-200 Fiber Length Analyzer (Kajaani Automation Inc.). Energy applied to the fibers is indicated by the total Specific Net Refining Power (SNRP) was 127 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20%), and sodium bicarbonate. Surface sizing using hydroxyethylated starch and sodium chloride was also employed but is not critical to the invention. In the 3$^{rd}$ Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.17. Moisture levels after the calender were 7.0% to 9.0% by weight. Paper base B was produced at a basis weight of 117 g/mm$^2$ and thickness of 0.1070 mm.

A coating was then applied to the laminated bottom biaxially oriented sheet on invention bases A and B using a gravure coater to add the high frequency roughness to the backside. The coating consisted of an aqueous solution containing a sodium salt of styrene sulfonic acid. The coverage used was 25 mg per square meter and then dried to achieve a final web temperature between 55° C., the resultant coalesced latex material produced the desired high frequency roughness pattern. In addition to the sodium salt of styrene sulfonic acid, aluminum modified colloidal silicon dioxide particles were added to the aqueous latex material at a concentration of 50 milligrams per square meter. This further enhanced the high frequency roughness.

The L3 layer for the biaxially oriented sheet is microvoided and further described in Table 4 where the refractive index and geometrical thickness is shown for measurements made along a single slice through the L3 layer; they do not imply continuous layers, a slice along another location would yield different but approximately the same thickness. The areas with a refractive index of 1.0 are voids that are filled with air and the remaining layers are polypropylene.

TABLE 4

| Sublayer of L3 | Refractive Index | Thickness, $\mu$m |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

Coating format 1 was utilized to prepare photographic print materials utilizing photographic supports A and B.

| Coating Format 1 | Laydown mg/m$^2$ |
|---|---|
| Layer 1 Blue Sensitive Layer | |
| Gelatin | 1300 |
| Blue sensitive silver | 200 |
| Y-1 | 440 |
| ST-1 | 440 |
| S-1 | 190 |
| Layer 2 Interlayer | |
| Gelatin | 650 |
| SC-1 | 55 |
| S-1 | 160 |
| Layer 3 Green Sensitive | |
| Gelatin | 1100 |
| Green sensitive silver | 70 |
| M-1 | 270 |
| S-1 | 75 |
| S-2 | 32 |
| ST-2 | 20 |
| ST-3 | 165 |
| ST-4 | 530 |
| Layer 4 UV Interlayer | |
| Gelatin | 635 |
| UV-1 | 30 |
| UV-2 | 160 |
| SC-1 | 50 |
| S-3 | 30 |
| S-1 | 30 |
| Layer 5 Red Sensitive Layer | |
| Gelatin | 1200 |
| Red sensitive silver | 170 |
| C-1 | 365 |
| S-1 | 360 |
| UV-2 | 235 |
| S-4 | 30 |
| SC-1 | 3 |
| Layer 6 UV Overcoat | |
| Gelatin | 440 |
| UV-1 | 20 |
| UV-2 | 110 |
| SC-1 | 30 |
| S-3 | 20 |
| S-1 | 20 |

-continued

| Coating Format 1 | Laydown mg/m$^2$ |
|---|---|
| Layer 7 SOC | |
| Gelatin | 490 |
| SC-1 | 17 |
| $SiO_2$ | 200 |
| Surfactant | 2 |

APPENDIX

Y-1

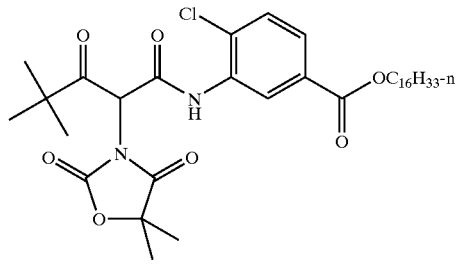

ST-1 = N-tert-butylacrylamide/n-butyl acrylate copolymer (50:50)
S-1 = dibutyl phthalate

SC-1

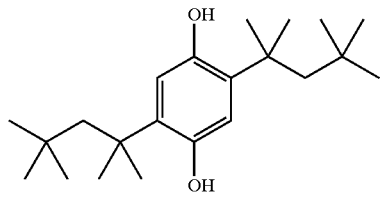

M-1

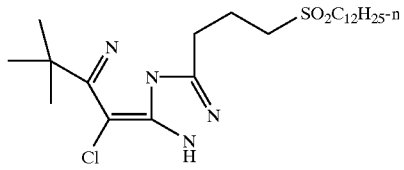

S-2 = diundecyl phthalate

ST-2

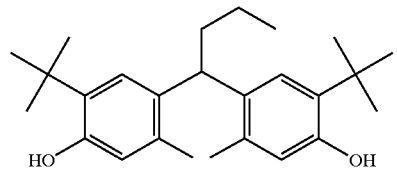

ST-3

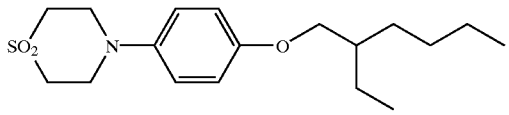

ST-4

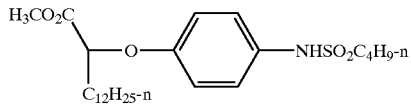

APPENDIX-continued

UV-1

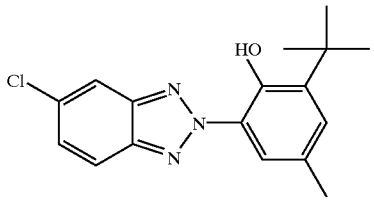

UV-2

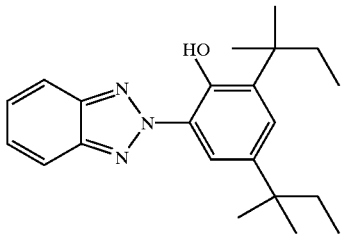

S-3 = 1,4-Cyclohexyldimethylene bis(2-ethylhexanoate)

C-1

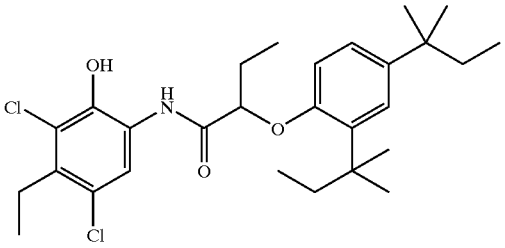

S-4 = 2-(2-Butoxyethoxy)ethyl acetate

Dye 1

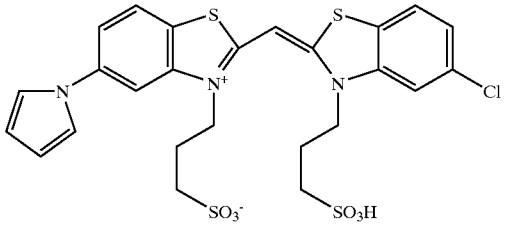

The structure of invention photographic element invention A (invention) was the following:

Coating Format 1

Top biaxially oriented polyolefin sheet with $TiO_2$

Ethylene plastomer

Coated cellulose paper base with basis weight of 117 g/m$^2$

Ethylene plastomer

Bottom biaxially oriented polyolefin sheet

Sodium salt of styrene sulfonic acid

The structure of photographic element invention B (control) was the following:

Coating Format 1

Top biaxially oriented, microvoided polyolefin sheet with $TiO_2$, blue tint and optical brightener Ethylene plastomer with 14% anatase $TiO_2$ Cellulose paper base with 2% rutile $TiO_2$, 117 g/m$^2$ basis weight and 0.10% blue dye Ethylene plastomer Bottom biaxially oriented polyolefin sheet Sodium salt of styrene sulfonic acid The two materials of this example (invention and control) were measured for MD/CD stiffness, Federal profiler, Thickness, L*, opacity, MTF, tear resistance, photographic processing back marking, writability and curl at 70% RH. The bending stiffness of the A and B photographic elements were measured by using the Lorentzen and Wettre stiffness tester, Model 16D. The output from this instrument is force, in millinewtons, required to bend the cantilevered, unclasped end of a sample 20 mm long and 38.1 mm wide at an angle of 15 degrees from the unloaded position. In this test the stiffiess in both the machine direction and cross direction of the photographic element A and B was compared. L* or lightness and opacity was measured for using a Spectrogard spectrophotometer, CIE system, using illuminant D6500.

The surface roughness of the emulsion side of each photographic element was measured by a Federal Profiler at three stages of sample preparation, in the paper base form, after extrusion lamination and after silver halide emulsion coating. The Federal Profiler instrument consists of a motorized drive nip which is tangent to the top surface of the base plate. The sample to be measured is placed on the base plate and fed through the nip. A micrometer assembly is suspended above the base plate. The end of the mic spindle provides a reference surface from which the sample thickness can be measured. This flat surface is 0.95 cm diameter and, thus, bridges all fine roughness detail on the upper surface of the sample. Directly below the spindle, and nominally flush with the base plate surface, is a moving hemispherical stylus of the gauge head. This stylus responds to local surface variation as the sample is transported through the gauge. The stylus radius relates to the spatial content that can be sensed. The output of the gauge amplifier is digitized to 12 bits. The sample rate is 500 measurements per 2.5 cm. The thickness of the product was measured with a Mitutoyo digital linear gauge using a measurement probe head of 20 mm$^2$.

The curl test measured the amount of curl in a parabolically deformed sample. A 8.5 cm diameter round sample of the composite was stored at the test humidity for 21 days. The amount of time required depends on the vapor barrier properties of the laminates applied to the moisture sensitive paper base, and it should be adjusted as necessary by determining the time to equilibrate the weight of the sample in the test humidity. The curl readings are expressed in ANSI curl units, specifically, 100 divided by the radius of curvature in inches. The radius of curvature is determined by mounting the sample perpendicular to the measurement surface, visually comparing the curled shape, sighting along the axis of curl, with standard curves in the background. The standard deviation of the test is 2 curl units. The curl may be positive or negative, and for photographic products, the usual convention is that the positive direction is curling towards the photosensitive layer.

Sharpness, or the ability to replicate fine details of the image, was measured by mathematical calculations utilizing a method is called the MTF or Modulation Transfer Function. In this test, a fine repeating sinusoidal pattern of photographic density variation near the resolution of the human eye was exposed on a photographic print. When the image was developed, the resulting density variation was compared to the expected density, and a ratio was obtained to determine the magnitude of the transfer coefficient at that frequency. A number of 100 denotes perfect replication, and this number was relatively easy to obtain at spatial frequencies of 0.2 cycle/mm. At a finer spacing of 2.0 cycles/mm, typical color photographic prints have a 70 rating or 70% replication.

Tear resistance for the photographic elements is the moment of force required to start a tear along an edge of the photographic element. The tear resistance test used was originally proposed by G. G. Gray and K. G. Dash, Tappi Journal 57, pages 167–170 published in 1974. The tear resistance for the photographic elements is determined by the tensile strength and the stretch of the photographic element. A 15 mm×25 mm sample is looped around a metal cylinder with a 2.5 cm diameter. The two ends of the sample are clamped by an Instron tensile tester. A load is applied to the sample at a rate of 2.5 cm per minuet until a tear is observed at which time the load, expressed in N, is recorded. Bending cracking (fracture) of the biaxially oriented sheet of the invention and control were tested by wrapping the imaging elements of the example around a 8.0 mm radius steel rod, rolling the rod back and forth while the imaging element of the example is wrapped on the rod and then examining the imaging element for visual cracks in the image element.

The test results for the above tests are listed in Table 5 below.

TABLE 5

| | Photographic Element A | Photographic Element B |
|---|---|---|
| MD Stiffness (millinewtons) | 105 | 210 |
| CD Stiffness (millinewtons) | 113 | 207 |
| Federal Profiler (micrometers) | 0.17 | 0.2 |
| Thickness (micrometers) | 185 | 238 |
| L* | 93.5 | 94.2 |
| Opacity | 91.8 | 95.5 |
| MTF | 71 | 81 |
| Cracking | NO | YES |
| Tear Strength | 874 | 707 |
| Curl at 70% RH | 2 | 3 |

As the data above shows, the imaging element A of the invention provided improved mechanical properties compared to the control material B while providing acceptable image quality. While the L*, MTF and opacity were higher for the high quality control material that utilized a micro-voided biaxially oriented sheet, the invention material provided image quality comparable to silver halide imaging layers applied to a cast coated cellulose paper. The improved mechanical properties of the invention material are a result of the elimination of the micro-voided layer from the top biaxially oriented sheet. The application of the coating to the cellulose paper base of the invention, provided a significant improvement in the "smoothness" (Ra of 0. 17 micrometers for the invention compared to 0.20 micrometers for the control) of the image which results is a high quality glossy image well suited for consumer prints and roll feed, glue applied label for packages. Because the invention materials did not crease when subjected bending around a 8 mm radius, the invention materials are more crease resistant than the control materials which utilized a microvoided polymer layer. The significant improvement in crease resistance allows for a more durable consumer print materials as well as a durable roll feed, glue applied label. Further, the reduction in thickness of the invention (185 micrometers for the invention vs 238 for the control) allow for the creation of a imaging element that costs less to mail and is ideal for placement in an photographic album as the bulky support material takes less space.

Finally, because invention material is thin, strong, smooth and crease resistant, the invention material allows a high quality silver halide image to be applied to a package when the silver halide image is adhered a package with applied glue. In this format, the imaged, developed silver halide imaging are protected with an environmental protection layer and feed into labeling equipment is roll form. In the packaging step, the desired length of label is cut, wrapped around the package and glue is applied to the label to adhere it to the package. Because the support is manufactured in a traditional image creation process comprising traditional printer and processor equipment (that requires a support stiffness greater than 110 millinewtons) the invention material does not suffer transport problems that would occur with a typical prior art 50 micrometer roll feed glue applied polymer support material.

While this example is directed toward silver halide consumer print materials and silver halide label materials, it is understood that other image printing technologies may be used to deliver a high quality image. Imaging technologies such as ink jet printing, thermal dye transfer printing and electrophotographic printing have been shown to deliver a high quality image consistent with the invent of the invention.

The invention has been described in detail with particular reference to certain preferred embodiments thereof, but it will be understood that variations and modifications can be effected within the spirit and scope of the invention.

What is claimed is:

1. An imaging element comprising a coated paper base, a lower biaxially oriented polymer sheet, and an upper biaxially oriented polymer sheet wherein said upper biaxially oriented polymer sheet is nonvoided.

2. The imaging element of claim 1 wherein said imaging element has a light transmission of less than 20 percent.

3. The imaging element of claim 1 wherein said upper biaxially oriented sheet comprises a single layer.

4. The imaging element of claim 1 wherein said lower biaxially oriented sheet comprises a single layer.

5. The imaging element of claim 1 wherein said upper biaxially oriented sheet comprises a polyolefin polymer.

6. The imaging element of claim 1 wherein said upper biaxially oriented sheet comprises a polyester polymer.

7. The imaging element of claim 1 wherein said lower biaxially oriented sheet comprises an embossed bottom surface.

8. The imaging element of claim 1 wherein said lower biaxially oriented sheet comprises an embossed bottom surface having a surface roughness of between 0.02 and 2.0 $\mu$m.

9. The imaging element of claim 1 wherein said coated paper has a coating comprising up to 40 percent pigment.

10. The imaging element of claim 1 wherein said coated paper has a coating comprising up to 40 percent pigment and a polymer having a glass transition temperature of less than 64° C.

11. The imaging element of claim 10 wherein said coating further comprises polyethylene imine.

12. The imaging element of claim 10 wherein said pigment is selected from the group consisting of calcium carbonate and clay.

13. The imaging element of claim 1 wherein said imaging element further includes a primer layer above said upper biaxially oriented sheet.

14. The imaging element of claim 1 wherein said upper biaxially oriented sheet further comprises white reflecting pigment.

15. The imaging element of claim 1 wherein said upper biaxially oriented sheet further comprises white reflecting pigment in an amount of between 6 and 24 weight percent.

16. The imaging element of claim 10 wherein said coating further comprises optical brightener.

17. The imaging element of claim 1 wherein said coated paper has .an apparent density of less than 1.05.

18. The imaging element of claim 1 wherein said coated paper has a mechanical modulus greater than 6895 MPa.

19. The imaging element of claim 1 wherein said coated paper has an internal size of epichlorohydrin.

20. The imaging element of claim 1 wherein said upper and lower biaxially oriented sheets have a modulus of greater than 1034 MPa.

21. The imaging element of claim 1 having a thickness of less than 150 $\mu$m.

22. The imaging element of claim 1 further comprising at least one photosensitive silver halide layer.

23. The imaging element of claim 1 further comprising at least one ink jet receiving layer.

24. A method of forming an imaging element comprising providing a coated paper base, providing an upper biaxially oriented polymer sheet and a lower biaxially oriented polymer sheet, bringing said upper sheet and said lower sheet into contact with said coated paper base as an adhesive is applied between said sheets and said coated paper base, applying a primer to said upper biaxially oriented polymer sheet, and applying an imaging layer, wherein said lower sheet has its lower side embossed prior to bringing said sheet into contact with said coated paper base and said upper biaxially oriented polymer sheet is nonvoided.

25. The method of claim 24 further comprising applying a writable conductive layer to said lower sheet prior to applying said imaging layer.

26. The method of claim 24 wherein said upper biaxially oriented sheet comprises a single layer.

27. The method of claim 24 wherein said lower biaxially oriented sheet comprises a single layer.

28. The method of claim 24 wherein said upper biaxially oriented sheet comprises a polyolefin polymer.

29. The method of claim 24 wherein said upper biaxially oriented sheet comprises a polyester polymer.

30. The method of claim 24 wherein said lower biaxially oriented sheet comprises an embossed bottom surface.

31. The method of claim 24 wherein said lower biaxially oriented sheet comprises an embossed bottom surface having a surface roughness of between 0.02 and 2.0 $\mu$m.

32. The method of claim 24 wherein said coated coated paper has a coating comprising up to 40 percent pigment.

33. The method of claim 24 wherein said coated coated paper has a coating comprising up to 40 percent pigment and a polymer having a glass transition temperature of less than 64° C.

34. The method of claim 24 wherein said coating further comprises polyethylene imine.

35. The method of claim 24 wherein said pigment is selected from the group consisting of calcium carbonate and clay.

36. The method of claim 24 wherein said imaging element further includes a primer layer above said upper biaxially oriented sheet.

37. A method of labeling comprising providing a label comprising a imaging element comprising a coated coated paper base, a lower biaxially oriented polymer sheet, an upper biaxially oriented polymer sheet and a light sensitive silver halide imaging layer, imagewise exposing said silver halide imaging layer with a collimated beam of actinic radiation, developing an image, protecting image with a environmental protection layer, wrapping said label around a package and adhesively adhering said label to a package.

* * * * *